US005626542A

United States Patent [19]

Dalebout et al.

[11] Patent Number: 5,626,542

[45] Date of Patent: May 6, 1997

[54] FOLDING RIDER EXERCISER

[75] Inventors: William T. Dalebout; Richard B. Ellis, both of Logan, Utah

[73] Assignee: Icon Health & Fitness, Inc., Logan, Utah

[21] Appl. No.: 594,940

[22] Filed: Jan. 31, 1996

[51] Int. Cl.[6] ..... A63B 69/06

[52] U.S. Cl. ..... 482/96; 482/72; 482/95

[58] Field of Search ..... 482/96, 95, 72, 482/57, 112, 58, 51; 472/106, 110; 280/1.182, 1.183, 1.192, 1.203, 1.204

[56] References Cited

U.S. PATENT DOCUMENTS

| | | |
|---|---|---|
| D. 344,112 | 2/1994 | Smith . |
| D. 356,128 | 3/1995 | Smith et al. . |
| 2,145,940 | 2/1939 | Marlowe . |
| 3,446,503 | 5/1969 | Lawton . |
| 4,452,448 | 6/1984 | Ausherman . |
| 5,178,599 | 1/1993 | Scott . |
| 5,254,067 | 10/1993 | Habling et al. . |
| 5,299,997 | 4/1994 | Chen . |
| 5,338,277 | 8/1994 | Yang . |
| 5,356,357 | 10/1994 | Wang et al. . |
| 5,366,428 | 11/1994 | Liao . |
| 5,370,594 | 12/1994 | Grinblat . |
| 5,421,795 | 6/1995 | Chen . |
| 5,423,731 | 6/1995 | Chen . |
| 5,429,568 | 7/1995 | Chen . |
| 5,453,066 | 9/1995 | Richter, Jr. . |
| 5,458,553 | 10/1995 | Wu . |
| 5,464,378 | 11/1995 | Yu . |
| 5,478,298 | 12/1995 | Chen . |
| 5,503,608 | 4/1996 | Chang . |
| 5,507,710 | 4/1996 | Chen . |
| 5,520,599 | 5/1996 | Chen ..... 482/72 |

OTHER PUBLICATIONS

Diagram of Exercycle machine.

Cover page of Damark catalog dated May 1995 showing CSA's E–Force riding machine.

Cover page of Damark catalog dated Feb. 1996 showing Power Rider riding machine.

Cover page and p. 35 of Damark catalog dated Jul. 28, 1993 showing Voit's Gravity Rider riding machine.

User's Manual for Weslo Cardiotrainer—1995.

User's Manual for Lifestyler Cardio Fit—1994.

User's Manual for Aerobicrider.

User's Manual for Cardio–Trainer 456—undated.

Exerhealth's Healthrider Parts Description —dated Apr. 26, 1994.

User's Manual for Guthy–Renker Fitness' Power Rider —undated.

*Primary Examiner*—Jerome Donnelly

*Attorney, Agent, or Firm*—Trask, Britt & Rossa

[57] ABSTRACT

A riding exercise machine has a frame with a pull housing operable by a user on a seat. The pull housing is secured to a frame by a pin. Upon removal the riding machine can be folded. A push housing may also be incorporated into the machine.

17 Claims, 8 Drawing Sheets

FOLDING RIDER EXERCISER

BACKGROUND OF THE INVENTION

1. Field of the Invention

This application relates to riding exercise machines and more particularly to a riding exercise machine that may be reconfigured between a use configuration and a storage configuration.

2. State of the Art

Exercise machines in which the user mounts the machine and sits upon a moving seat interconnected to a handle which is pulled to raise the seat against the weight of the user may be regarded as riding exercise machines. For example, U.S. Pat. No. 4,300,760 (Bobroff) illustrates one form of exercise machine in which the user mounts the machine and operates a lever mechanism with the arms and the feet against a resistance which is the user's weight positioned upon the seat.

Commercial riding exercise machines are known including the HEALTHRIDER™ machine, sold by HealthRider, Inc. of Salt Lake City, Utah. The HEALTHRIDER machine has a frame with a rotatable or movable lever interconnected to a seat. The lever is operated by the user's hands and feet against the resistance of the user reclining on a seat in a fashion similar to that illustrated in the Bobroff patent. The CARDIOGLIDE machine sold by ICON Health & Fitness, Inc. of Logan, Utah also has a frame with a seat interconnected with a lever. It also has a resistance mechanism interconnected to resist movement of the lever and seat. U.S. Pat. No. 3,446,503 (Lawton) illustrates another form of riding machine in which a handle is interconnected with a seat. U.S. Pat. No. 5,299,997 (Chen) also shows a riding-type exercise machine in which the user's weight is used to resist movement of feet and hands. Other patents disclosing similar or related machines include U.S. Pat. No. 5,306,218 (Chen), U.S. Pat. No. 5,366,428 (Liao), U.S. Pat. No. 5,370,594 (Grinblat) and U.S. Pat. No. 5,356,357 (Wang, et al.).

SUMMARY OF THE INVENTION

A riding exercise machine is reconfigurable between a use configuration and a storage configuration. The machine has a base with a guide surface associated therewith. Feet means are attached to the opposite ends of the base to support the base on a support surface. User support means is rotatably attached to the base to be movable between a use configuration and storage configuration. The user support means supports a riding user thereon when in the user configuration. In the user configuration, the user support means is movable and preferably rotatable between a first position and a second position spaced from the first position.

Guide means are rotatably attached to the user support means to extend away therefrom. The guide means are in contact with the guide surface and are movable between a use configuration and a storage configuration. In the user configuration, the guide means is movable between a first position when the user support means is in its first position and a second position when the user support means is in its second position.

Forward support structure having a lower end and an upper end is also provided. The lower end of the forward support structure is removably attached to the base in the use configuration. It is detached from the base and reoriented toward alignment with the base in the storage configuration.

A pull receiver is preferably rotatably attached to the forward support structure to be movable between a first position and a second position spaced from the first position.

Handle structure having a handle portion for grasping and movement by a user riding on the user support means is also provided. The handle structure is mechanically associated with the pull receiver to be movable with the receiver from a use configuration to a storage configuration. When in the use configuration the handle structure is pullable from a first position when the receiver is in its first position to a second position when the pull receiver is in its second position. The handle structure in its second position is spaced toward the user support means from the handle structure first position. Attaching means are optionally associated with one of the handle structure and the pull receiver for removably securing the handle structure to the pull receiver.

Synchronizing means are also provide to extend between and to be rotatably connected to the pull receiver and to the guide means. The synchronizing means connects the pull receiver to the guide means so that upon movement of the pull receiver and the handle structure between their respective first positions and second positions, the guide means and in turn the user support means move from their respective first positions to their respective second positions. The synchronizing means is removably connected to be removed in the storage configuration and to be connected in the user configuration.

In an improved configuration, the forward support structure is removably attached to the base by a support connector. The support connector preferably includes apertures formed in the base and the forward support structure to be in registration to receive a pin therethrough. The pin is operable by a user to disassociate the forward support structure from the base.

In a preferred arrangement, the riding exercise machine also includes a push receiver rotatably adapted to the base to receive the handle structure in the use configuration for pushing movement by a riding user on the user support means. The push receiver is movable from a first position in which the user support means is in its first position, to a second position in which the user support means is in its second position and the handle structure is spaced further away from the user on the user support means than when the handle structure is in its first position.

In the preferred arrangement, the synchronizing means includes first connecting means having a first end and a second end. The first end of the connecting means is rotatably connected to the pull receiver. The second end of the first connecting means is rotatably connected to the push receiver. The first connecting means connects the pull receiver to the push receiver so that upon movement of the user support means from its first position to its second position, the pull receiver moves from its first position to its second position.

The preferred arrangement also includes second connecting means having a first end and a second end. The first end is rotatably connected to the push receiver. The second end is rotatably connected to the guide means. The second connecting means is connected to the push receiver and to the guide means so that upon movement of the push receiver, as well as the pull receiver, between their first positions and their second positions, the guide means moves from its first position to its second position. At the same time, the user support means moves from its first position to its second position.

In an alternate and preferred arrangement, the user support means includes a support member with a seat positioned proximate its distal end. In a preferred arrangement, the pull receiver and the push receiver are each receptacles sized to slidably and snugly receiver the handle structure therein. Locking means may be provided to lock the handle structure in the pull receiver and in the push receiver.

The first connecting means and the second connecting means are each rotatably attached to the push receiver to rotate about a common axis. Desirably the handle structure also has a lower portion to which foot means are attached to support the feet of a riding user.

In a preferred arrangement, the base is a box beam having an upper surface that functions as the guide surface. The guide means desirably includes a guide member rotatably attached to the support member. The guide member is a wheel which is rotatably attached proximate the distal end of the guide member. The wheel contacts the guide surface to move thereon and therealong.

In yet an alternate preferred arrangement, the locking means is configured to lock the handle structure at a plurality of spaced apart locations along the length of the handle structure. Preferably the forward support structure is a pair of spaced apart members in substantial alignment. The pull receiver is rotatably attached proximate the upper end of the forward support structure.

Other configurations of riding exercise machines are also contemplated in which only a pull receiver is provided. In such a configuration, the synchronizing structure may be a single strap extending between the pull receiver and the guide means. The single strap may be removably connected either to the pull receiver or the guide means so the riding machine may be reconfigured from a use configuration to a storage configuration.

BRIEF DESCRIPTION OF THE DRAWINGS

In the drawings which illustrate what is presently regarded are preferred embodiments.

DETAILED DESCRIPTION OF THE EMBODIMENT

Figure 1:
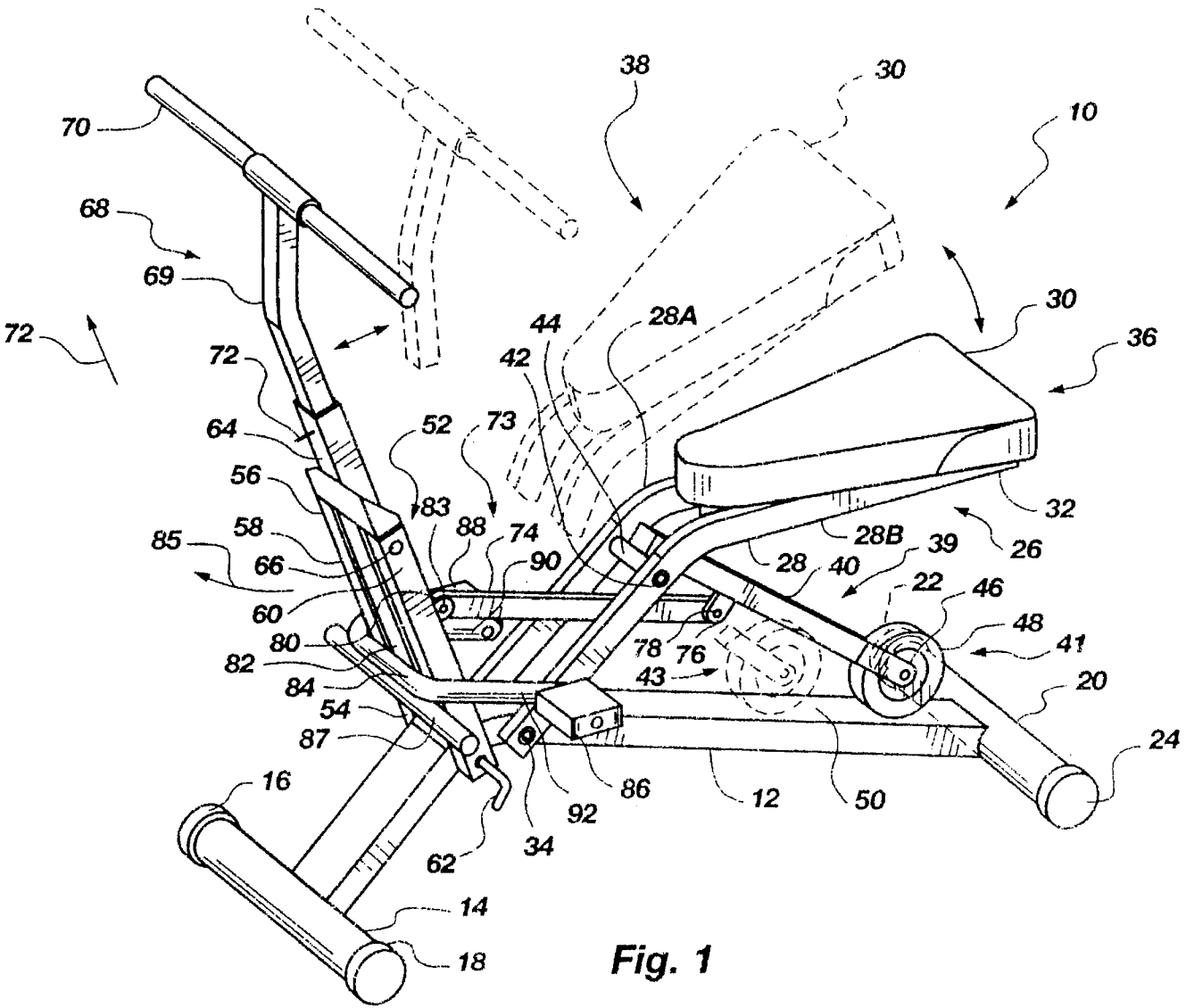
FIG. 1 is a simplified perspective view of a riding exerciser of the invention.

The riding exerciser 10 of FIG. 1 has a base 12 with feet means associated therewith to support the riding exerciser 10 on a support surface. The feet means as here illustrated include a forward foot 14 which is fastened to the base 12 by welding, bolts or other acceptable means. The forward foot 14 is a cylindrically-shaped tube with a pair of end caps 16 and 18 secured to its outer ends. The end caps 16 and 18 may be made out of a soft or rubber-like or plastic-like material to provide for frictional contact with the support surface without causing any marring or scratching.

The feet means also includes a rear foot 20 attached to the base 12. The rear caps 22 and 24 which are similarly made of a rubber-like or plastic-like material for frictional contact with the support surface while minimizing the risk of scratching or marring of the support surface.

User support means 26 is rotatably attached to the base 12. The user support means 26 includes a support member 28 having a seat or cushion 30 affixed proximate the distal end 32 of the support member 28. As here seen, the support member 28 is comprised of a right tube 28A and a left tube 28B spaced apart to receive other components thereinbetween as discussed hereinafter.

The support member 28 is rotatably attached by a pin or axle 34 to the base 12. The pin or axle 34 passes through apertures formed in the right tube 28A, the left tube 28B and the base 12 to provide for rotation of the user support means 26 from the first position 36 to a second position 38 (shown in dotted line) in FIG. 1. That is, the user support means 26 rotates about the axle on pin 34 between a first position and a second position spaced from the first position during the performance of exercise. Of course, the weight of the user residing on the seat 30 resists movement of the user support means 26 from the first position 36 toward the second position 38.

The riding machine of FIG. 1 also includes guide means 39 rotatably connected to the user support means 26 to extend away therefrom. More specifically, guide means 39 includes a guide member 40 which is rotatably connected to the user support means 26 and more particularly the support member 28. A pin or axle 42 extends through appropriate apertures formed in the right support tube 28A and left support tube 28B. A bushing or spacer 44 is interpositioned between the right tube 28A and the left tube 28B with the axle 42 passing therethrough. The guide support 40 is fixedly attached to the bushing 44 such as by welding and in turn is rotatable about the axle 42.

At the distal end 46 of the guide member 40 is a wheel 48 which is in contact with the guide surface 50. The guide surface 50 is here shown to be the upper surface of the box beam or rectangular tube which constitutes the base 12. The wheel 48 moves along the guide surface 50 as the user support means moves between its first position 41 as shown in solid and its second position 43. Of course the guide means 39 is in its first position 41 when the user support means 26 is in its first position 36; and the guide means 39 is in its second position 43 when the user support means is in its second position 38.

A forward support structure 52 is attached to the base 12 forward of the user support means 26. The forward support structure 52 has a lower end 54 and an upper end 56. The lower end 54 is removably attached to the base 12. The forward support structure is here shown to be composed of a spaced apart right support member 58 and a left support member 60. The right support member 58 and the left support member 60 are spaced apart to fit comfortably over and about the base 12. Suitable apertures are formed in the base 12 as well as in the right support member 58 and left support member 60. When in registration, the pin 62 is inserted therein to removably attach the forward support structure 52 to the base 12. Although a pin 62 is shown, other structures may be used to effect removable attachment including bolts, axles or the like.

A pull receiver 64 is rotatably attached proximate the upper end 56 of the forward support structure 52 to rotate about a pin, shaft or axle 66 which passes through appropriately formed apertures in the right support member 58 and the left support member 60. The axle 66 may also pass through appropriately provided apertures in the receiver 64 that are placed in registration to receiver the axle 66.

Figure 2:
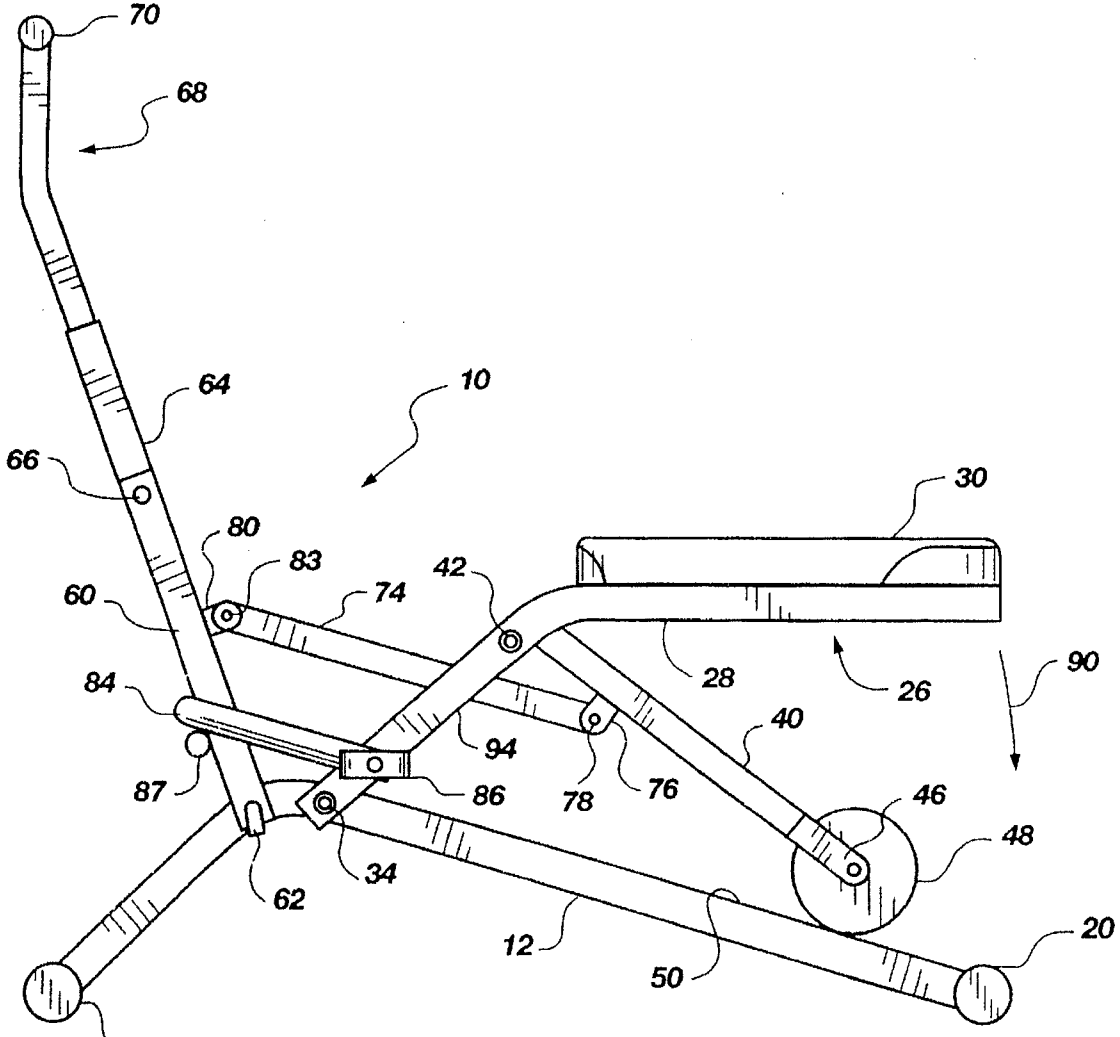
FIG. 2 is a simplified side-view of the riding exerciser of FIG. 1 in a use configuration.

Handle structure 68 is also provided. It has a handle portion 70 for grasping and movement by a user riding on the user support means 26. The handle structure 68 has an extension 69 which is inserted into the receiver 64 to be movable with the receiver between a use configuration as shown in FIGS. 1 and 2 as well as a storage configuration as better seen in FIG. 3.

The handle structure 68 is pullable by a user positioned on the seat 30 from a first position shown in solid in FIG. 1 to a second position partially shown in dotted line in FIG. 1. In other words, as the receiver 64 is rotated from its first position to a second position, the handle 68 rotates from its first position to its second position which is spaced away from the first position toward the user positioned on the user support means 26 and more particularly on the seat 30.

Attaching means may also be provided to attach the receiver 64 and the handle structure 68. More specifically, attaching means may be provided to inhibit relative movement between the receiver 64 and the handle structure 68. A spring-loaded pin 72 or other similar structure may be used to provide for a positive connection between the receiver 64 and the handle member 68. The handle member 68 may also be provided with a plurality of apertures along its length to register with the spring-loaded pin 72. In turn, the user may be able to adjust the height 72 of the handle structure 68 relative to the receiver 52 to a height desirable or comfortable for use in pulling the handle portion 70 towards the user positioned on the seat 30.

The exerciser 10 of FIG. 1 also has synchronizing means 73 which are provided to synchronize movement between the receiver 64 and in turn the handle structure 68 with the user support means 26. More specifically, the synchronizing means 73 is here shown to be a strap 74 that extends between and is rotatably attached to the pull receiver 64 and to the guide member 40. Upon movement of the pull receiver 64, the guide member 40 moves along the guide surface 50 in turn urging the support member 28 upward about the axle 34 against the weight of the user.

As can be seen, the strap 74 is rotatably attached to a bracket 76 by a pin 78. The bracket 76 is welded or bolted to the guide member 40. The pin 78 may be a removable locking pin, a bolted axle or any other similar arrangement that provides for rotation and for removal.

The strap 74 is also attached to a bracket 80 attached by bolts or the like to the pull receiver 64 by pin 83. Thus, as the lower end 82 of the pull receiver 64 rotates clockwise 85 about the axle 66, the strap 74 pulls the guide member 40 and in turn causes the seat 30 to move upward.

Foot means is also attached to the pull receiver 64. The foot means is here comprised of a bar 84 welded to the lower portion 82 of the pull receiver to extend rigidly toward the user. A pair of pedals 86 and 88 are rotatably attached to the distal ends 90 and 92 of the bar 84. The pedals 86 and 88 provide a surface to receiver the feet of the user positioned on the seat 30. An alternate foot rest 87 may be also provided and welded to the pull receiver 64. Thus, the user may place the user's feet on the pedals 88 and 86 or on the associated bar 87 to apply force and urge rotation about the axle 66.

Figure 3:
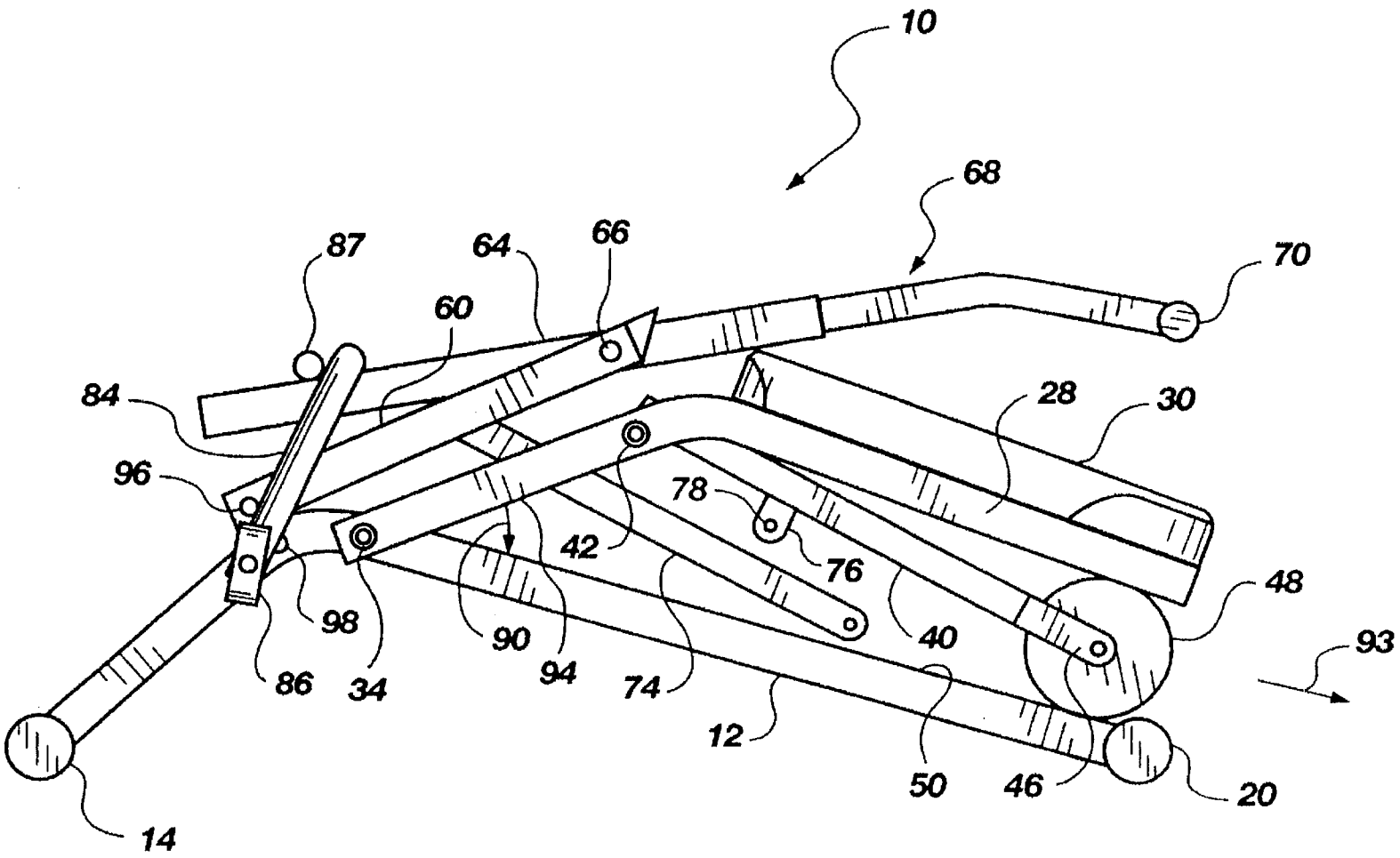
FIG. 3 is a simplified side-view of the riding exerciser of FIG. 2 in a storage configuration.

Referring now to FIGS. 2 and 3, FIG. 2 shows the riding exerciser of FIG. 1 in a use configuration. In the use configuration, the riding exerciser 10 may be movable between a first position and a second position as discussed. Synchronized movement of the user support means 26 and the pull receiver 64 is effected by the strap 74 to cause movement of the pull receiver 64 from the first position shown in solid to the second position shown in dotted line in FIG. 1 upon movement of the user support means 26 from its first position to its second position.

FIG. 3 shows the riding exerciser 10 in the storage configuration. The strap 74 is disconnected from the bracket 76. The disconnection and connection may be effected by removal and reinserting the pin or bolt 78. Alternately, the strap 74 may be configured similar to that shown in FIG. 8 as more fully discussed hereinafter. The strap 74 may also be disconnected from the bracket 80 as desired.

Upon disconnection, the user support means 26, and more particularly the user support 28 may be rotated from the user position downward toward the base 12 to be proximate the wheel 48 of the guide means 39. As the support member 28 rotates clockwise 90 about the axle or pin 34, the guide member 40 and the wheel 48 move rearwardly 93 on guide surface 50. Upon removable of the pin 62, the forward support structure 58 may be lifted off of the base 12 and rotated towards the base 12 to be generally in alignment with the lower portion 94 of the support member 28. At the same time, the pull receiver 64 moves with the forward support structure 58 and is rotated towards the base 12.

The handle structure 68 is here shown inserted into the pull receiver 64. In a selected arrangement, the handle structure 68 may be removed from the pull receiver 64 and positioned on or adjacent to the remaining components of the riding machine 10.

The riding machine 10 of FIG. 3 in the storage configuration is configured to occupy less space than in the use configuration. In turn it may be placed in a closet, under a bed or behind a piece of furniture. It may also be more easily packaged into a box for shipment to a customer. Of course, assembly is easily effected by rotating the forward support structure 58 so that apertures 96 and 98 are in registration to receive the pin 62. The strap 74 can then be reconnected to be rotatable about the axis 78 of the bracket 76 connected to the guide member 40.

Figure 4:
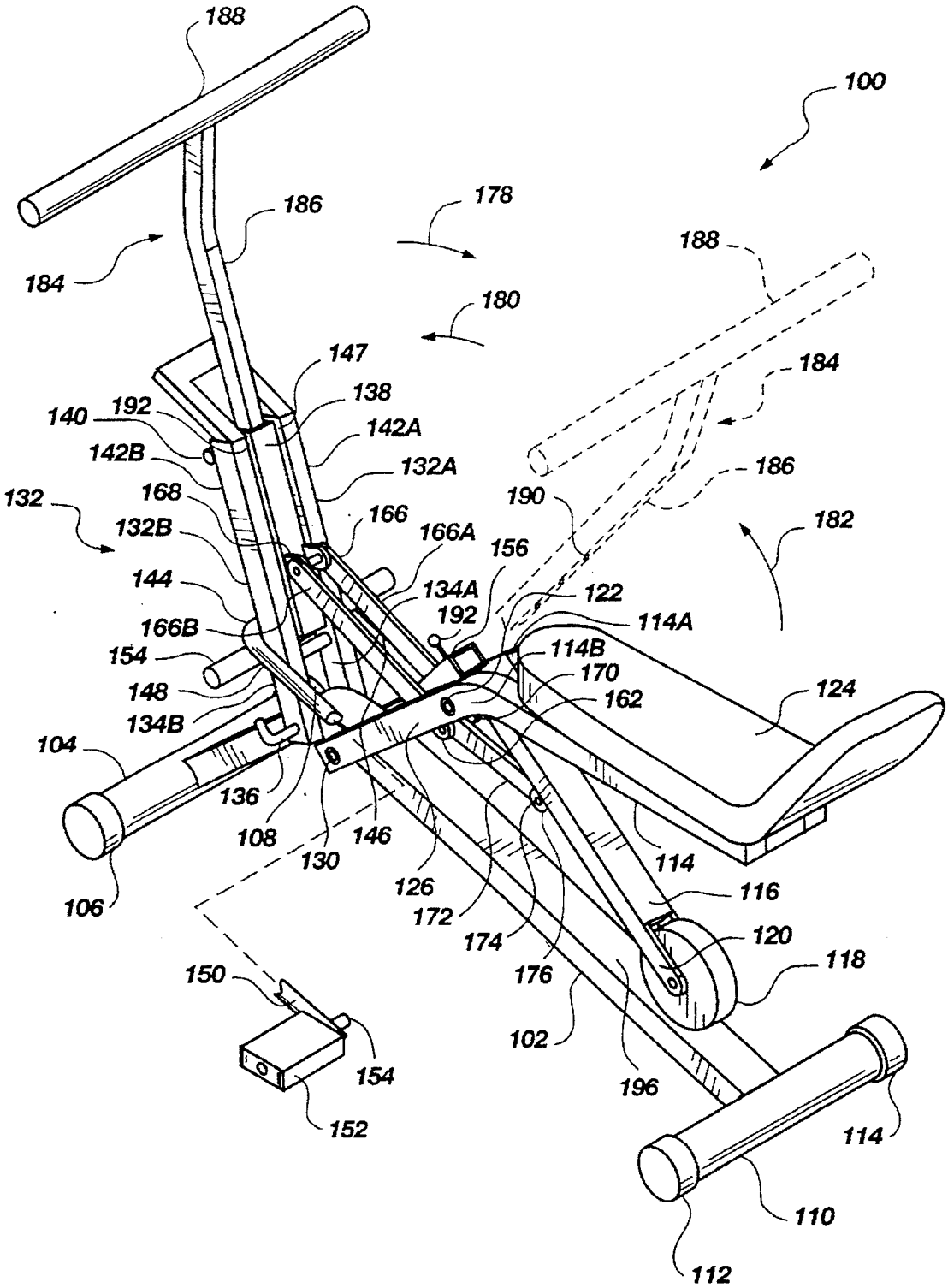
FIG. 4 is a perspective, simplified broken view of an alternate riding exerciser of the invention.

In reference to FIG. 4, a riding exerciser 100 has a base 102 with feet means associated therewith. As here shown, the feet means include a forward foot 104 having end caps 106 and 108 which are similar to end caps 16 and 18. The feet means also include a rear foot 110 with respective end caps 112 and 114 similar to the end caps 22 and 24. The base 102 is connected to the forward foot 104 and rear foot 110 by welding, by bolts or by other acceptable means.

User support means here comprised of a support member 114 which has a right support 114A and a left support 114B each spaced apart from each other to receive a guide member 116 of the guide means. The guide means includes a guide member 116 with a wheel 118 rotatably attached its distal end 120. The guide member 116 is connected to a bushing 123 which rotates around an axle 122 in a fashion similar to that described with respect to the axle 42 of FIG. 1.

The support member 114 includes a seat 124 which is fixedly secured to the support member 114A and 114B by screws, bolts or the like not here shown. The support member 114 and the seat 124 are rotatable from a first position as shown in solid in FIG. 4 to a second position spaced away therefrom similar to that shown for FIG. 1 and not here shown for clarity.

The support member 114 is here shown to have a lower portion 126 rotatably attached to the base to rotate about a pin or axle 130. Appropriate apertures are formed in the base 102 as well as in the left support member 114B and the right support member 114A to register with an appropriate pin or axle.

Forward support structure 132 includes a right support 132A and a left support 132B which are spaced apart from each other. The right support 132A and the left support 132B have apertures formed proximate their lower ends 134A and 134B to register with a corresponding aperture (not shown) to receive pin 136 which is similar to pin 62 in FIG. 1.

A pull receiver 138 is rotatably attached to rotate about an axle 140 to the upper portion 142A and 142B of the forward support structure. The axle 140 may pass through a bushing which is welded to the right member 132A and the left member 132B. The receiver 138 may be pulled from the first position shown in solid in FIG. 4 to a second position oriented towards a user on the seat 124 similar to that shown by dotted lines in FIG. 1. The pull receiver 138 has attached thereto by welding or by bolt a foot support structure 144 which has a right rearward extending portion 146 and a left rearward extending portion 148. The left rearward extension 148 is broken apart for purposes of clarity with the broken portion 150 displaced by a dotted line only for clarity. That is the portion 150 and the left rearward extension 148 are formed as one piece and are here shown as two only for clarity. A left pedal 152 is shown rotatable attached by a pedal pin 154 to receive the feet of a user riding or sitting on the seat 124. A right pedal is also provided, but not shown. A separate foot bar 154 may also be provided to provide an alternate location for the user's feet.

Figure 7:
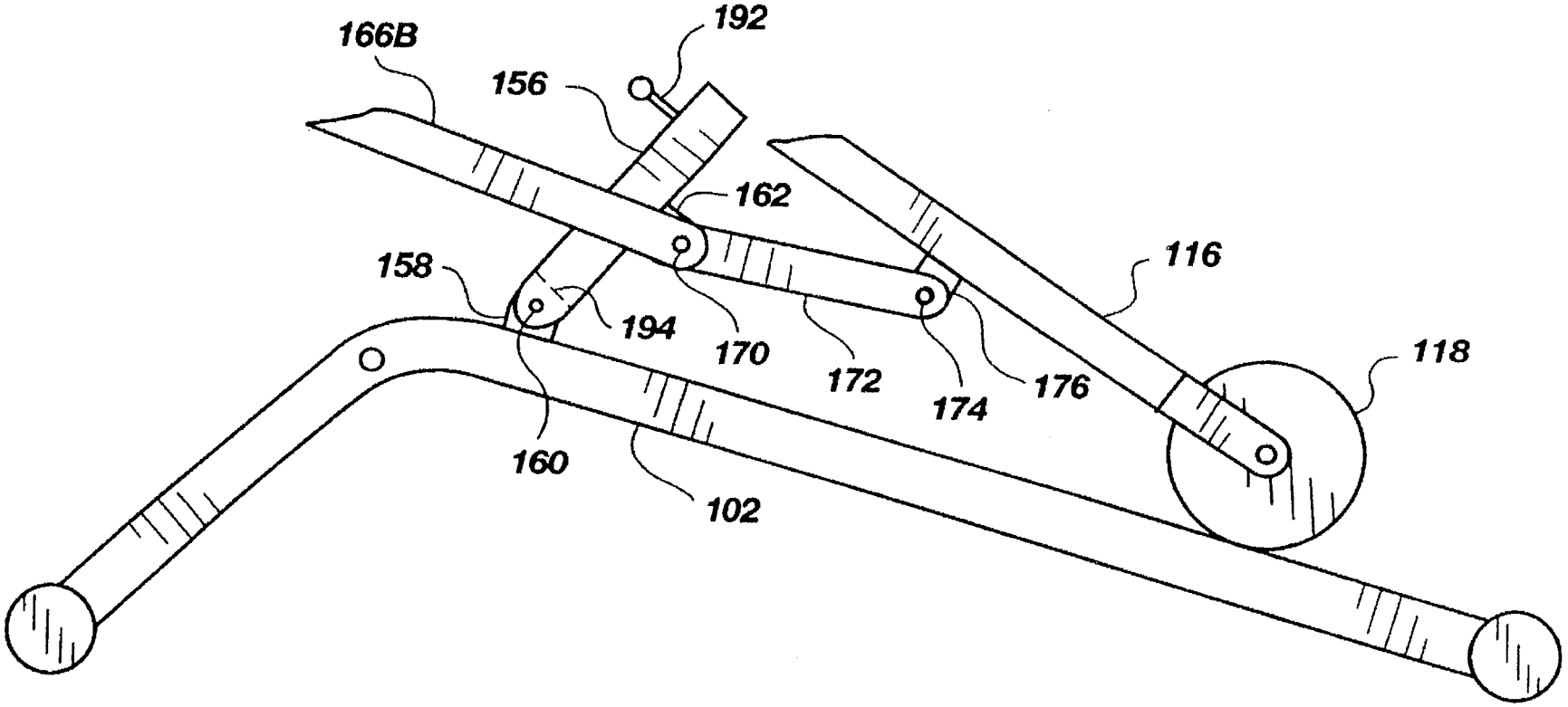
FIG. 7 are potions of the riding exerciser of FIG. 5 in a simplified side-view.

In the arrangement of FIG. 4, a push receiver 156 is provided. The push receiver 156, as more clearly shown in FIG. 7, is rotatably attached to the base 102 by a bracket 158 and a pin or axle 160.

Synchronizing structure is provided for the rider machine 100 of FIG. 4 to synchronize the operation of the pull receiver 138, the push receiver 156, and the user support means. A separate bracket 162 is secured such as by welding to the underside or backside 164 of the push receiver 156. A first connecting means in the form of a strap 166 is shown connected by an appropriate bracket 168 to the pull receiver 138. As here shown, the strap 166 has a tight member 166A and a left member 166B. The strap 166 is rotatably secured to the bracket 162 by a pin or axle 170. Thus, upon movement of the pull receiver 138, the push receiver is also displaced. The push receiver 156 is connected by second connecting means which is here a strap 172 to the guide means and more specifically the guide member 116 by a pin or axle 174 to bracket 176 secured by welding or the like to the guide member 116. Thus, as the pull receiver 138 rotates clockwise 178, the push receiver 156 rotates counterclockwise 180. In turn, the guide member 116 is urged forwardly to in turn urge the user support and more particularly the support member 114 counterclockwise or upward 182 towards its second position.

Handle structure 184 includes an extension 186 plus a handle portion 188 for grasping and movement by a user position on the user support means and more particularly the seat 124. With the extension 186 positioned in the pull receiver 138 as shown, the user may pull on the handle 188 thus causing the seat 124 to rotate upward. Thus the user pulls the handle 188 towards the user positioned on the seat 124.

The handle structure 184 may be removed from the forward receiver 138 and positioned in the push receiver 156 as shown in dotted line in FIG. 4. Upon positioning handle structure 184 and more particularly the extension 186 into the push receiver 156, a user positioned on the seat 124 may now push on the handle portion 188 and in turn cause the guide member 116 to move forwardly and in turn urge the seat 124 upwardly towards a second position. With the handle structure 184 shown in the push receiver 156 shown in a first position in FIG. 4, the handle structure and in turn the push receiver 156 can be rotated counterclockwise to a second position.

It may be also noted that handle extension 186 has a plurality of apertures 190 formed therein spaced apart and along the length. The apertures 190 may be positioned to be in registration with a locking pin 191 to lock the handle structure 184 at a desired height or length for a user positioned on the seat 124. The push receiver has a stop or ledge 194 within its interior to inhibit further downward movement of the handle extension 186 and a locking pin 192. The pull receiver 138 has a similar stop or limitation 195.

As can be seen in operation, a user positioned on the seat 124 may pull on the handle 188 and thereby cause the handle structure 184 and the receiver 138 to rotate around the axle 140. In turn, the guide member 116 and the wheel 118 move along the guide surface 196 to turn urge the support member 114 and the seat 124 upward or counterclockwise. The user may also position the user's feet on the foot bar 154 or the pedals 152 to assist and cause similar movement of the receiver 138 and the support member 114.

As hereinbefore stated positioning the handle structure 184 in the push receiver allows the user to now operate the riding machine in a push mode in which the user pushes on the handle 188 in order to achieve upward movement of the support member 114 and in turn the seat 124.

Figure 5:
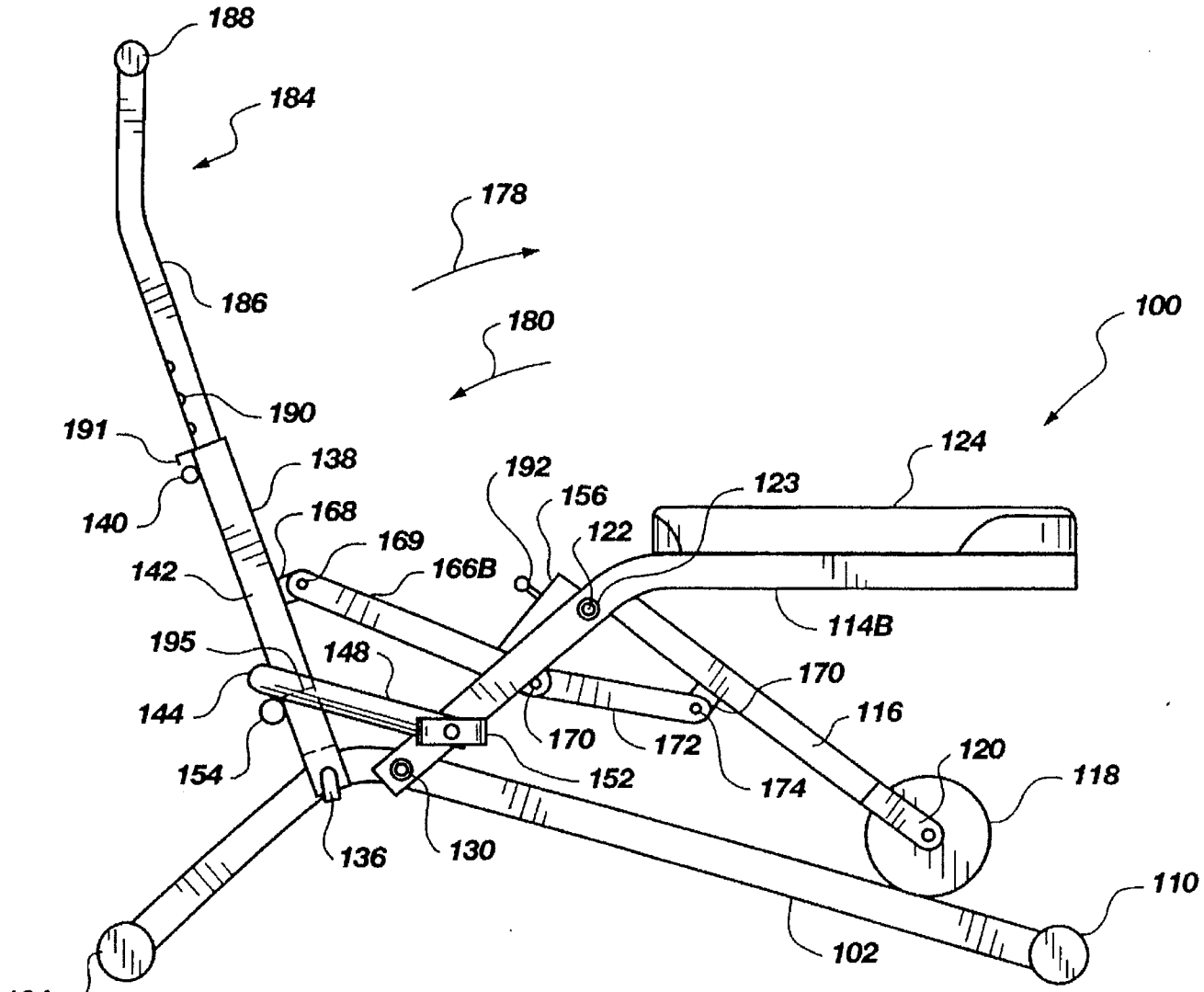
FIG. 5 is a simplified side-view of the riding exerciser of FIG. 4 in a use configuration.

Referring now to FIG. 5, it can be seen that the riding machine 100 of FIG. 4 is shown in a more simplified format in a first position in the user configuration. While in the use configuration, the machine 100 may be operated between a first position and a second position with the components displaced or rotated as hereinbefore discussed.

Figure 6:
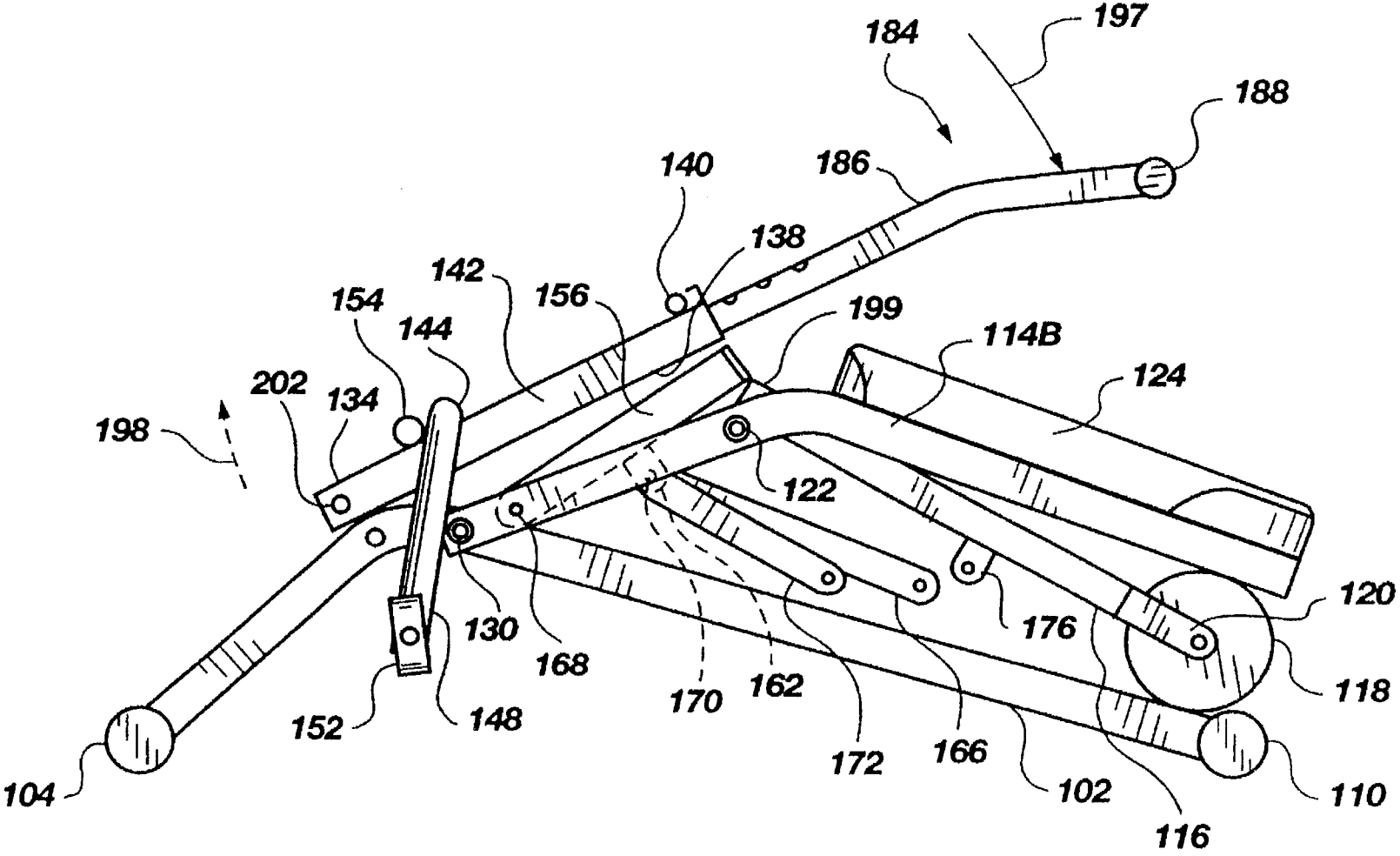
FIG. 6 is a simplified side-view of the riding exerciser of FIG. 5 in the storage configuration.

The riding exerciser 100 is shown in FIG. 6 in a storage configuration. To place the riding exerciser 100 in the storage configuration from a use configuration, the straps 166A and 166B are disconnected from the bracket 168. A removable pin or the like 169 may facilitate removal. The strap 172 is also disconnected from the bracket 176 again by removing a pin 174. The straps 166A and 166B may be folded to extend rearward by lifting the support member 114 upward to a point where they may be rotated inward. In alternate configurations, the straps 166A and 166B may be allowed to extend in the slots 192 and 194 best seen in FIG. 4. The straps 166A an 166B are sufficiently flexible to permit their extension into those slots 192 and 197 as the user support system is rotated in to its storage configuration.

With the straps 166 and the strap 172 disconnected from the user support means and more particular the support member 114 and the scat 124 are rotated clockwise towards the guide means to a point where the support member 114 is proximate the wheel 118 as shown. The push receiver 156 is also urged clockwise to cause it to rotate toward the support member 114 and the base 102 to a point where it is in contact with the inward end 149 of the guide member 116. The forward support structure 142 may be disconnected from the base 102 by removing the pin 136. The forward support member 142 thereupon is rotated toward the push receiver 156. The pull receiver 138 rotates with the forward support member 142 towards the base 102. As here shown, the handle structure 184 is shown connected to the pull receiver 138. Application of pressure 197 in a clockwise direction to the handle 188 will cause the lower end 134 of the forward support structure to rotate in an upward direction 198. In an appropriate shipping box, the lid or top may be closed to apply the pressure 197. Alternatively the handle structure 184 may be removed from the pull receiver 138 and positioned on or adjacent the other components of the riding exerciser 100. In turn the volume necessary for shipping or for storage may be reduced.

Figure 8:
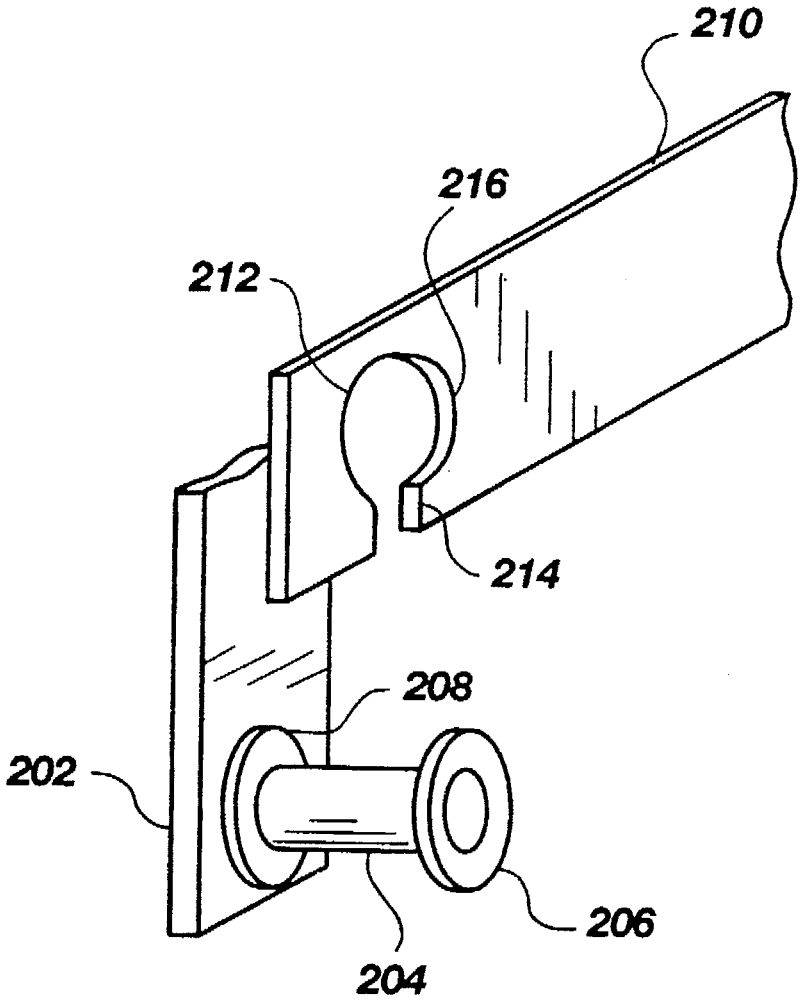
FIG. 8 is a simplified partial perspective view of a connecting structure for use with the riding exercise machines of FIGS. 1 and 4.

Referring now to FIG. 8, a sample bracket 202 is shown with an appropriate exterior cap flange 206 that may be threaded or force fit on the shaft 204. An interior washer 208 acts as a strap 210 similar to strap 172 or straps 166A and 166B is configured with a key slot 212. Upon movement of the strap 210 towards the axle 204, the key slot 212 is registered with the axle 204 through the throat portion 214 to provide for a tight or snug fit while still providing for ease in rotation upon entry of the axle 204 into the eye 216 of the key slot 212.

When positioned over the axle 204, the head 206 is exterior of the strap 210 and the washer 208 is interior. Thus the strap 210 is retained on the axle 204 to prevent it from sliding off.

Although the machine of FIGS. 4 and 5 is shown to be of the type which can be reconfigured between a use configuration and a storage configuration, it should be understood that the machine of FIG. 4 may also be arranged to not be collapsible to a storage configuration.

Reference herein to specific details of the embodiments is not intended to limit the scope of the claims which themselves recite those features which are regarded as essential to the invention.

What is claimed is:

1. A riding exercise machine reconfigurable between a use configuration and a storage configuration, said riding machine comprising:

a base having a guide surface associated therewith;

feet means attached to said base for supporting said base on a support surface;

user support means for supporting a riding user thereon, said user support means being rotatably attached to said base to be movable between a use configuration and a storage configuration, and in said use configuration to be moveable between a first position and a second position spaced from said first position;

guide means rotatably connected to said user support structure to extend away therefrom and to contact said guide surface, said guide means being moveable between a use configuration and a storage configuration, and in said use configuration said guide means being movable between a first position when said user support means is in its first position and a second position when said user support means is in its second position;

forward support structure having a lower end and an upper end, said lower end being attached to said base in said use configuration and being detached from said base and oriented toward alignment with said base in said storage configuration;

a pull receiver rotatably attached to said forward support structure to be movable between a first position and a second position rotatably spaced from said first position;

a push receiver rotatably adapted to said base for pushing movement by a riding user on said user support means from a first position in which said user support means is in its first position to a second position in which said user support means is hi its second position;

handle structure having a handle portion for grasping and movement by a user riding on said user support means, said handle structure being mechanically associatable with said pull receiver to be moveable with said pull receiver from a use configuration to a storage configuration and when in said use configuration to be pullable from a first position when said pull receiver is in its first position to a second position when said pull receiver is in its second position, said second position of said handle structure being spaced toward said user support means from said first position of said handle and said handle structure being mechanically associatable with said push receiver to be moveable from a first position in which said push receiver is in its first position to a second position in which said push receiver is in its second position;

attaching means associated with one of said handle structure and said pull receiver and said push receiver for removably attaching said handle structure to one of said push receiver and said pull receiver;

synchronizing means extending between and connected to said pull receiver and to said guide means, said synchronizing means including, first connecting means having a first end and a second end, said first end being rotatably connected to said pull receiver and said second end being rotatably connected to said push receiver, said first connecting means connecting said pull receiver to said push receiver so that upon movement of said user support means from its first position to its second position, pull receiver moves from its first position to its second position;

second connecting means having a first end and a second end, said first end being rotatably connected to said push receiver and said second end being rotatably connected to said guide means, said second connecting means connecting said push receiver to said guide means so that upon movement of said push receiver between its first position and its second position, said guide means moves from its first position to its second position; and wherein said synchronizing means is disconnected from said guide means in said storage configuration and is connected in said use configuration.

2. The riding machine of claim 1, wherein said user support means includes a support member with a seat positioned proximate its distal end.

3. The riding machine of claim 2 wherein said pull receiver and said push receiver are each a receptable sized to slidably and snugly receive said handle structure therein.

4. The riding machine of claim 3 further including locking means to lock said handle structure in said pull receiver and said push receiver.

5. The riding machine of claim 4, wherein said first connecting means and said second connecting means are each rotatably attached to said push receiver to rotate about a common axis.

6. The riding machine of claim 5, wherein said handle structure has a lower portion and wherein foot support means are attached to said lower portion to support the feet of a riding user.

7. The riding machine of claim 6, wherein the base is a box beam and wherein said guide surface is the upper surface of said box beam.

8. The riding machine of claim 7, wherein said guide means includes a guide member having a wheel rotatably attached proximate its distal end to contact said guide surface and to move thereon.

9. The riding machine of claim 8 wherein said handle locking means is configured to lock said handle structure at a plurality of spaced apart locations along the length of said handle structure.

10. The riding machine of claim 9 wherein said forward support structure is a pair of spread apart members in substantial alignment, and wherein said pull receiver is rotatably attached proximate the upper ends of said forward support structure.

11. A riding exercise machine comprising:

a base having a guide surface associated therewith;

feet means attached to said base for supporting said base on a support surface;

user support means for supporting a riding user thereon, said user support means being rotatably attached to said base to be movable between a first position and a second position spaced from said first position;

guide means rotatably connected to said user support structure to extend away from and to contact said guide surface;

forward support structure having a lower end and an upper end, said lower end being attached to said base;

a pull receiver rotatably attached to said forward support structure to be moveable between a first position and a second position;

handle structure having a handle portion in a first position for grasping and movement by a user riding on said user support means, said handle being removable, and rotatably mounted to said receiver to be pullable from a first position to second position spaced from said first position and toward said user support means;

a push receiver rotatably attached to said base to receive said handle structure for pushing movement by a riding user on said user support means from a first position in which said user support means is in its first position to a second position in which said user support means is in its second position;

first connecting means having a first end and a second end, said first end being rotatably connected to said pull receiver and said second end being rotatably connected to said push receiver, said first connecting means connecting said pull receiver to said push receiver so that upon movement of said user support means from its first position to its second position, said handle structure moves from its first position to its second position;

second connecting means having a first end and a second end, said first end being rotatably connected to said push receiver and said second end being rotatably connected to said guide means, said second connecting means connecting said push receiver to said guide means so that upon movement of said user support means between its first position and second position said guide means moves from a first position to a second position spaced from said first position.

12. The riding machine of claim 11, wherein said user support means is a support member with a seat positioned proximate its distal end.

13. The riding machine of claim 12, wherein said push receiver and said pull receiver are each a receptables sized to slidably and snugly receive said handle structure therein.

14. The riding machine of claim 13, wherein said first connecting means and said second connecting means are each rotatably attached to said push receiver to rotate about a common axis.

15. The riding machine of claim 14, wherein said handle structure has a lower portion and wherein foot support means are attached to said lower portion to support the feet of a riding user.

16. The riding machine of claim 15, wherein the base is a box beam and wherein said guide surface is the upper surface of said box beam.

17. The riding machine of claim 16, wherein said guide means is a guide member having a wheel attached to contact said guide surface and to move thereon.

* * * * *